US010662611B1

(12) United States Patent
Mohns

(10) Patent No.: US 10,662,611 B1
(45) Date of Patent: May 26, 2020

(54) LOADING BUCKET WITH PUSHER

(71) Applicant: Brad Mohns, Jackson, MN (US)

(72) Inventor: Brad Mohns, Jackson, MN (US)

( * ) Notice: Subject to any disclaimer, the term of this patent is extended or adjusted under 35 U.S.C. 154(b) by 0 days.

(21) Appl. No.: 15/224,097

(22) Filed: Jul. 29, 2016

(51) Int. Cl.
*E02F 3/40* (2006.01)
*E02F 3/407* (2006.01)
*E02F 3/34* (2006.01)

(52) U.S. Cl.
CPC ..... *E02F 3/407* (2013.01); *E02F 3/34* (2013.01)

(58) Field of Classification Search
CPC . E02F 3/407; E02F 3/144; E02F 3/342; E02F 3/3417
See application file for complete search history.

(56) References Cited

U.S. PATENT DOCUMENTS 2,372,870 A 4/1945 Willrodt
2,468,378 A 4/1949 Scofield
2,873,874 A 2/1959 Best
2,973,876 A 3/1961 Voss
3,066,429 A * 12/1962 Hancock ..... E02F 3/6481 137/625.67
3,523,621 A * 8/1970 Anderson ..... E02F 3/407 414/725
3,738,030 A * 6/1973 Olinger ..... E02F 3/401 414/725
3,777,915 A * 12/1973 Reed ..... E02F 3/6481 414/509
3,916,545 A * 11/1975 Hochmann ..... E02F 3/6436 37/426
4,041,625 A * 8/1977 Fisher ..... E02F 3/6481 414/513
4,366,635 A * 1/1983 Joyce, Jr. ..... E02F 3/6481 37/416

* cited by examiner

*Primary Examiner* — Gerald McClain
(74) *Attorney, Agent, or Firm* — Jeffrey A. Proehl; Woods, Fuller, Shultz & Smith, PC

(57) ABSTRACT

A loading bucket may comprise a bucket body with an interior and a front and a rear. The bucket body has a lower wall with a forward edge and an upper surface, a rear wall, a pair of opposite side walls, and at least one guide being positioned adjacent to a juncture of the lower wall and one side wall. The bucket may include a pusher mounted on the bucket body to move along the guide over the lower wall upper surface between retracted and extended positions. The retracted position may be characterized by the pusher being located toward the rear wall of the body and the extended position may be characterized by the pusher being moved away from the rear wall of the bucket body. The bucket may include a pusher actuation assembly configured to move the pusher between the retracted and extended positions.

23 Claims, 10 Drawing Sheets

LOADING BUCKET WITH PUSHER

BACKGROUND

Field

The present disclosure relates to loader buckets and more particularly pertains to a new pusher loading bucket for pushing the contents from the bucket without requiring, for example, tilting of the bucket.

SUMMARY

In one aspect, the present disclosure relates to a loading bucket comprising a bucket body at least partially defining an interior and having a front and a rear. The bucket body may have a lower wall with a forward edge oriented toward the front of the bucket body and an upper surface, a rear wall extending upwardly from the lower wall, a pair of opposite side walls extending upwardly from opposite ends of the lower wall, and at least one guide being positioned adjacent to a juncture of the lower wall and one of side walls to form a guide channel. The bucket may also include a pusher mounted on the bucket body and being movable along the at least one guide over the upper surface of the lower wall of the bucket body between a retracted position and an extended position. The retracted position may be characterized by the pusher being located toward the rear wall of the bucket body and the extended position may be characterized by the pusher being moved away from the rear wall of the bucket body toward the front of the bucket. The bucket may further comprise a pusher actuation assembly configured to move the pusher with respect to the bucket body between the retracted position and the extended position.

In another aspect, the disclosure relates to a loading system comprising a loader having at least one lift arm and a loading bucket mounted on the at least one lift arm of the loader. The loading bucket may comprise a bucket body at least partially defining an interior and having a front and a rear. The bucket body may have a lower wall with a forward edge oriented toward the front of the bucket body and an upper surface, a rear wall extending upwardly from the lower wall, a pair of opposite side walls extending upwardly from opposite ends of the lower wall, and at least one guide being positioned adjacent to a juncture of the lower wall and one of side walls to form a guide channel. The bucket may also include a pusher mounted on the bucket body and being movable along the at least one guide over the upper surface of the lower wall of the bucket body between a retracted position and an extended position. The retracted position may be characterized by the pusher being located toward the rear wall of the bucket body and the extended position may be characterized by the pusher being moved away from the rear wall of the bucket body toward the front of the bucket. The bucket may further comprise a pusher actuation assembly configured to move the pusher with respect to the bucket body between the retracted position and the extended position.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
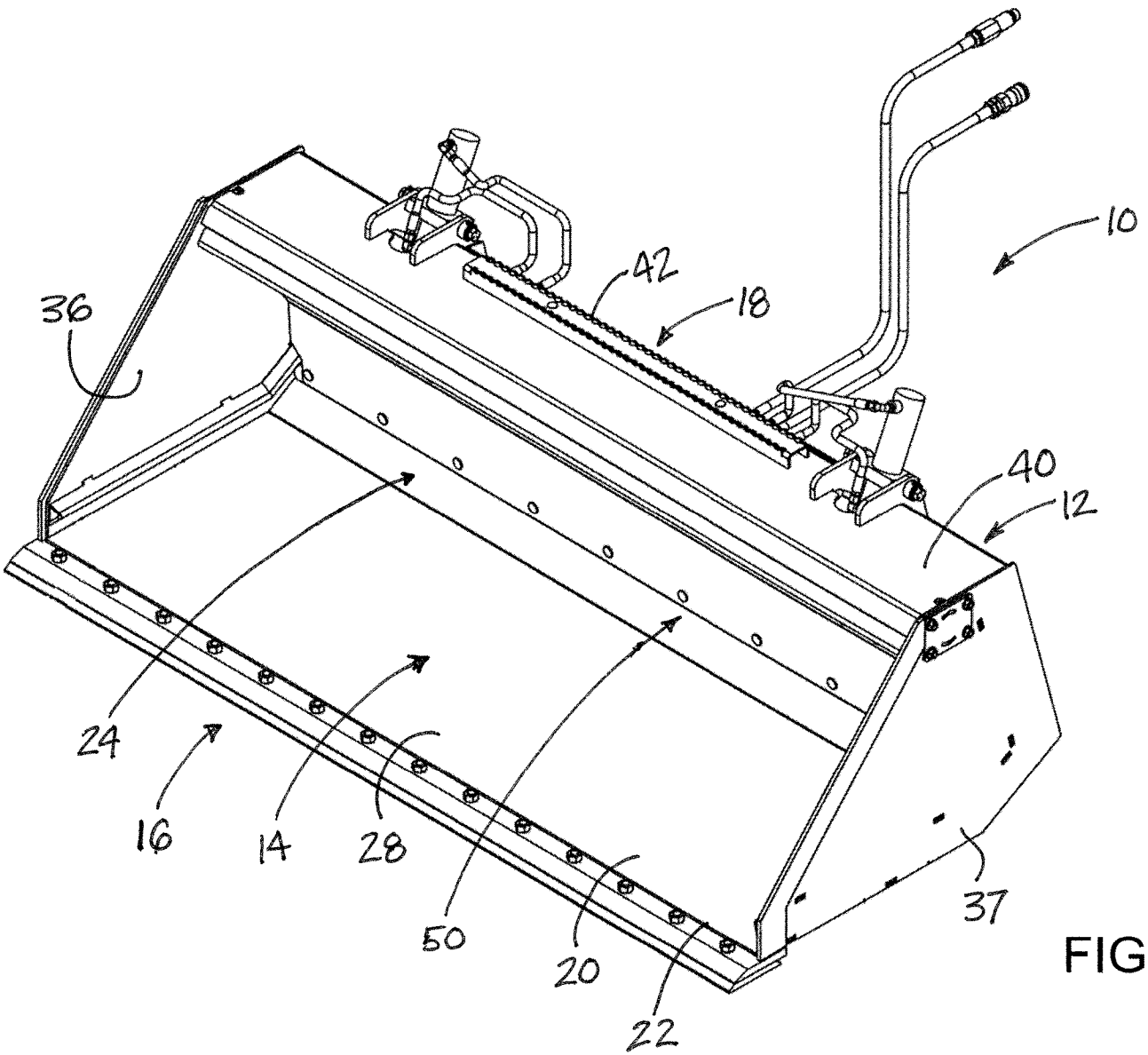
FIG. 1 is a schematic perspective view of a new pusher loading bucket according to the present disclosure.
Figure 2:
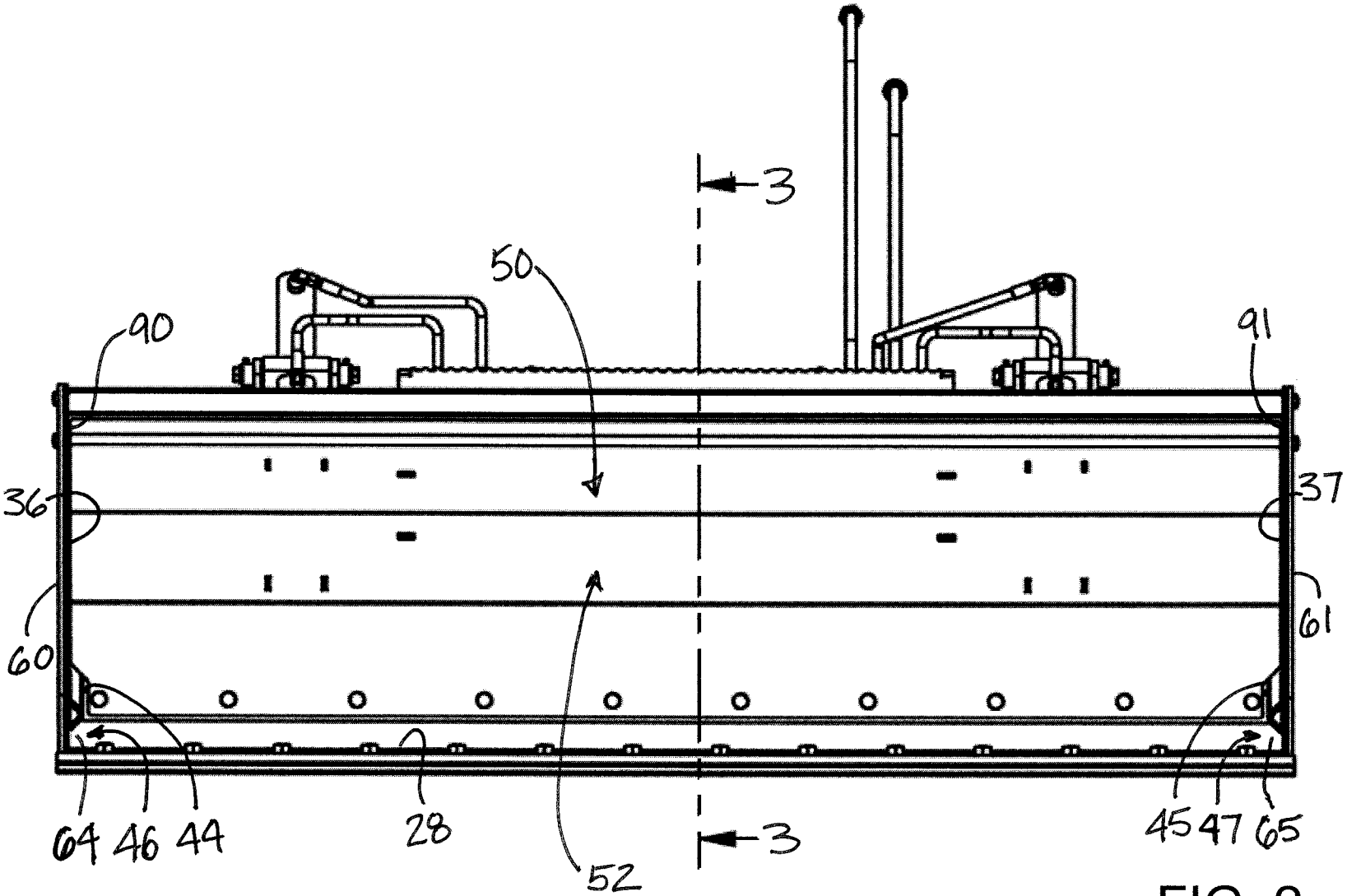
FIG. 2 is a schematic front view of the pusher loading bucket according to the present disclosure.
Figure 3A:
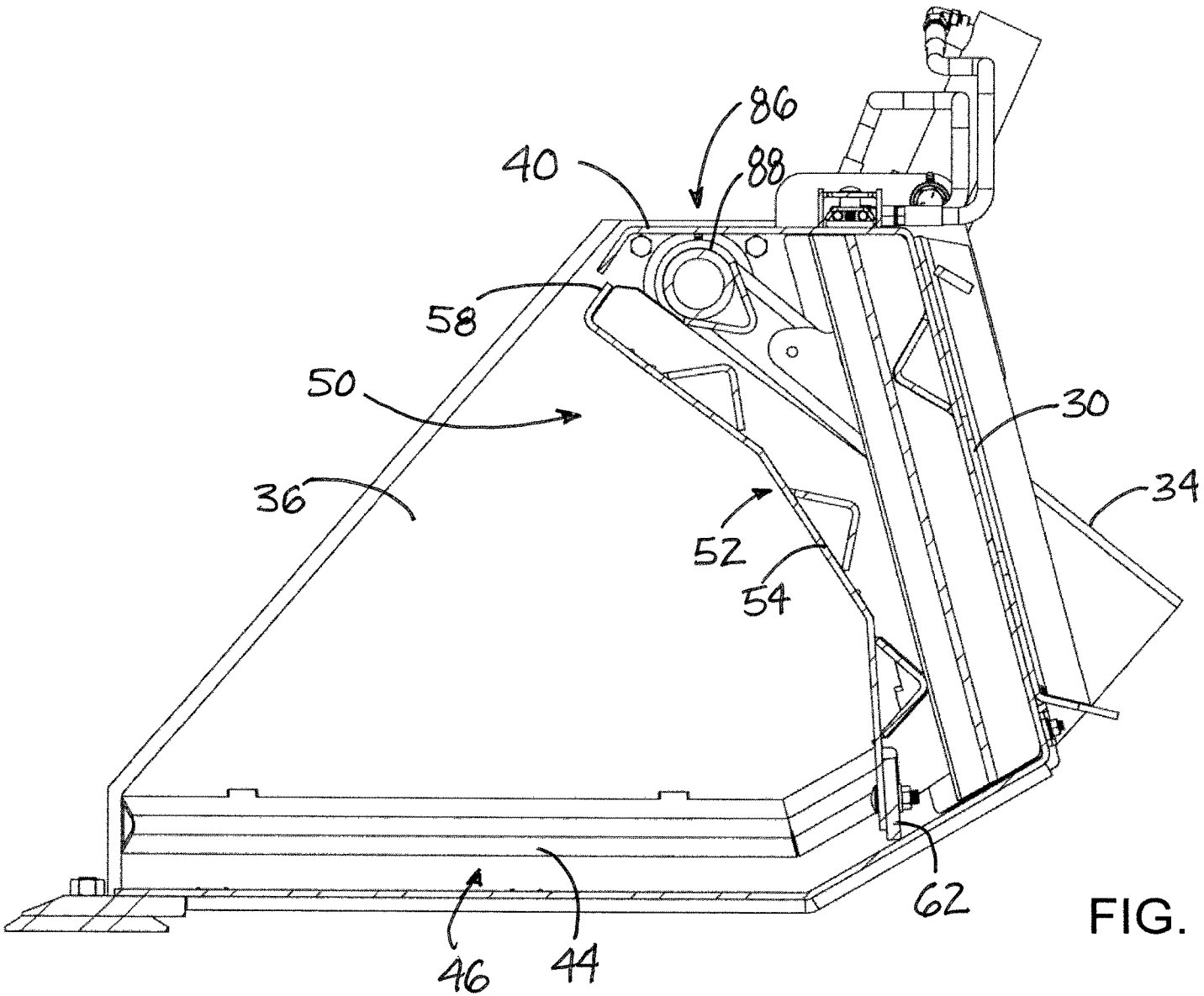
FIG. 3A is a schematic side sectional view of the pusher of the pusher loading bucket in the retracted position taken along line 3-3 of FIG. 2, according to an illustrative embodiment.
Figure 3B:
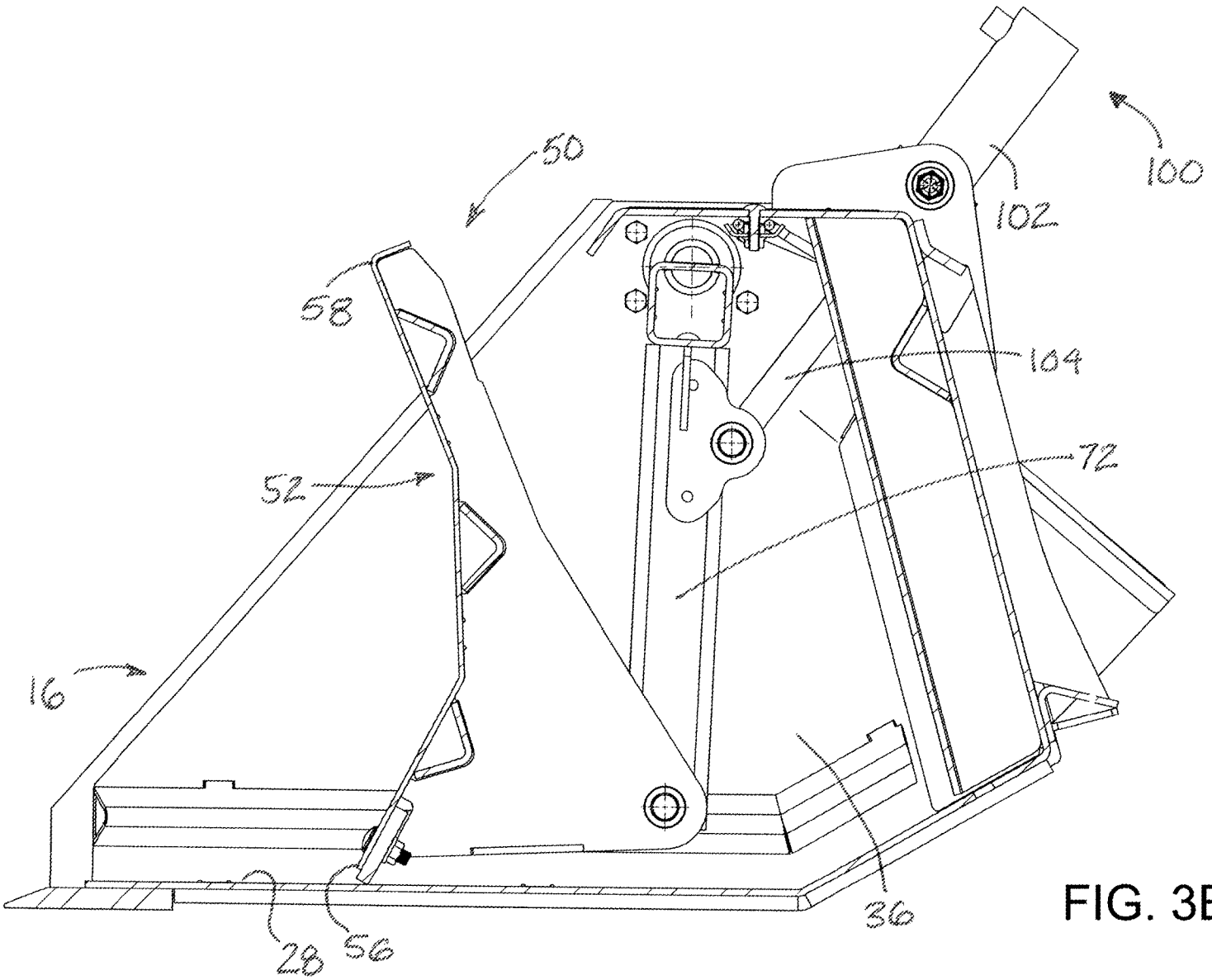
FIG. 3B is a schematic side sectional view of the pusher of the pusher loading bucket in a position intermediate of the retracted and extended positions of the pusher, according to an illustrative embodiment.
Figure 3C:
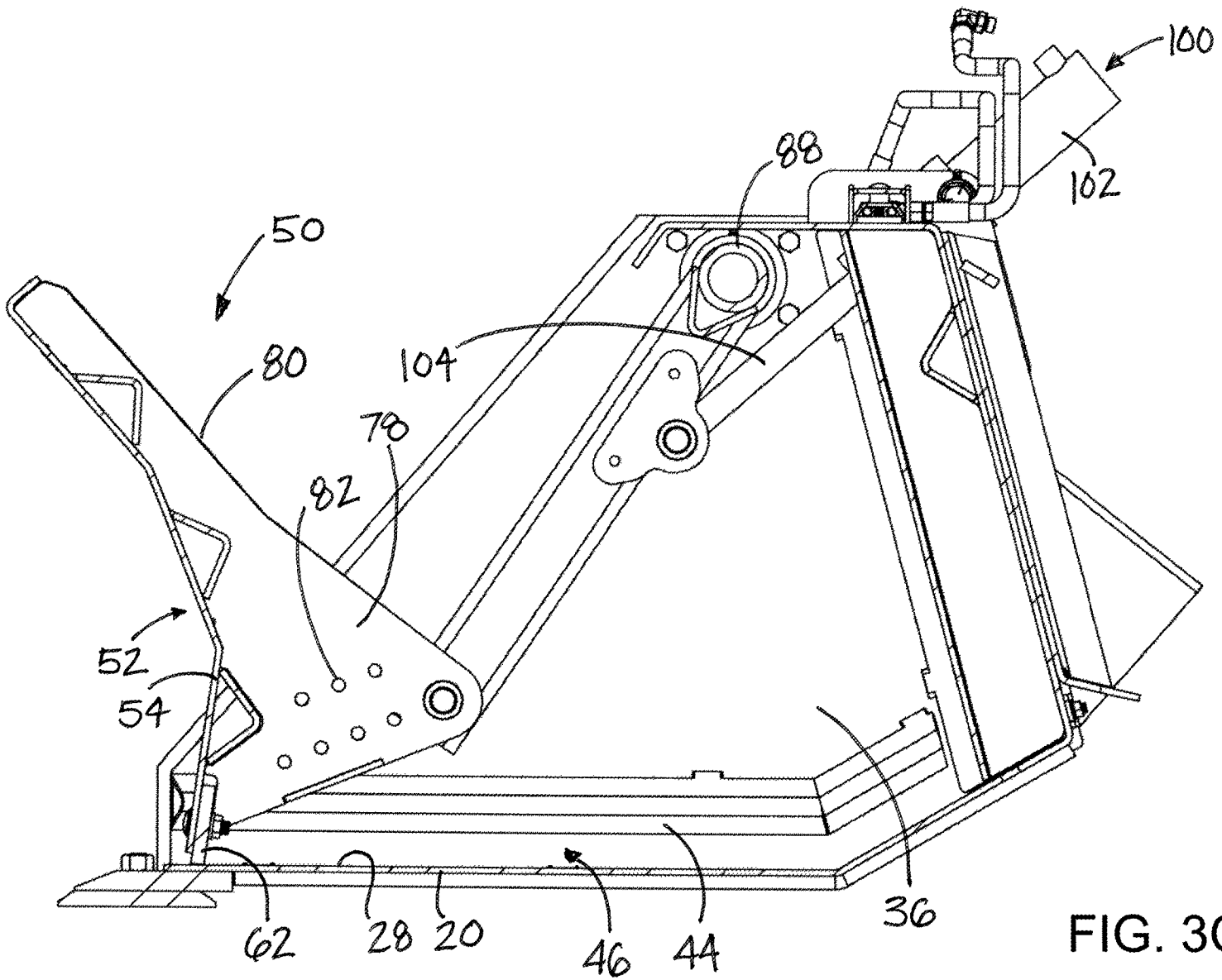
FIG. 3C is a schematic side sectional view of the pusher of the pusher loading bucket in the extended position, according to an illustrative embodiment.
Figure 4:
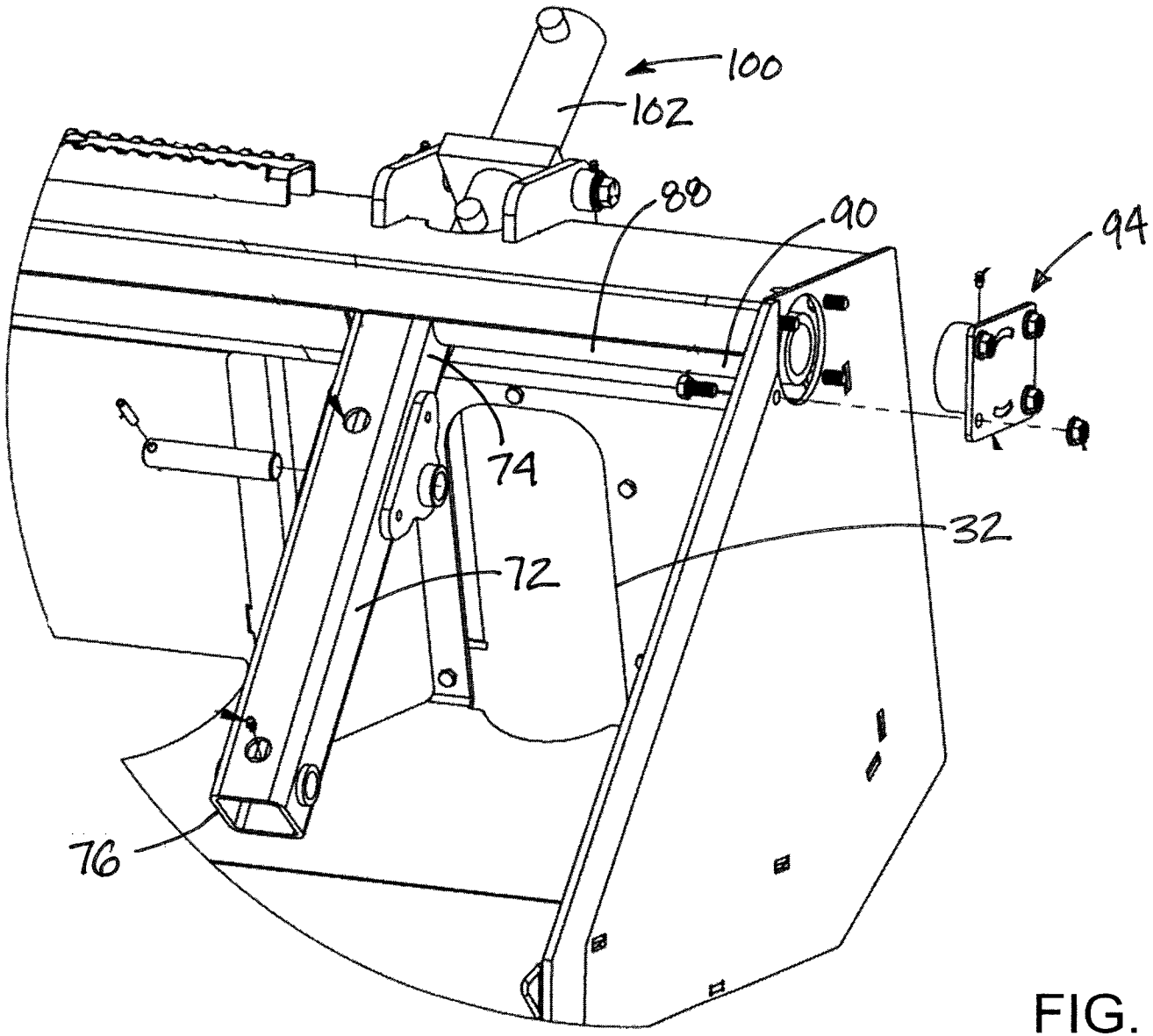
FIG. 4 is a schematic perspective view of a portion of the pusher loading bucket with the pusher removed to reveal detail of the pusher actuation assembly, according to an illustrative embodiment.
Figure 5:
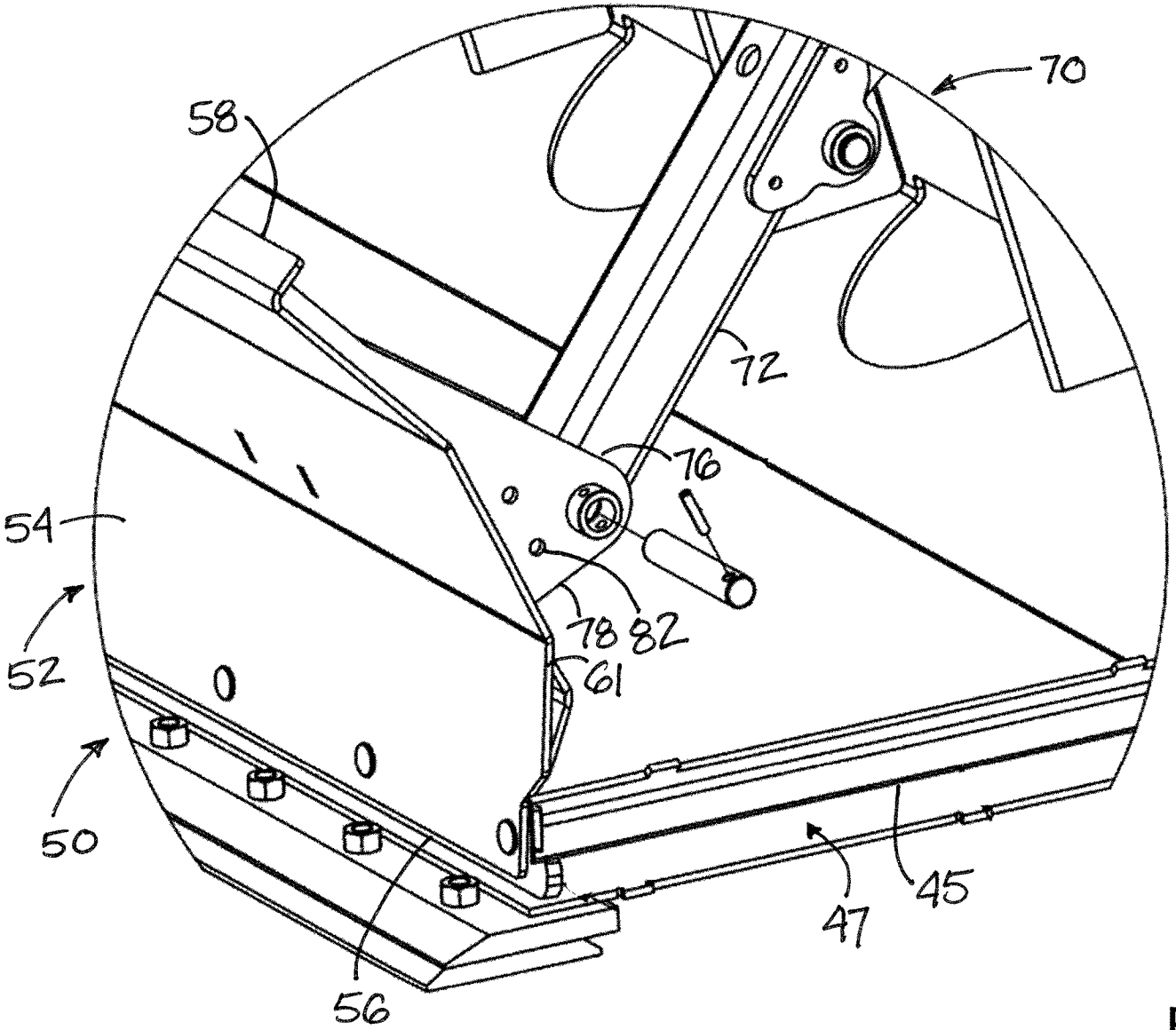
FIG. 5 is a schematic perspective view of the pusher loading bucket with a side wall of the bucket body removed to reveal detail of the pusher and pusher actuation assembly, according to an illustrative embodiment.
Figure 6:
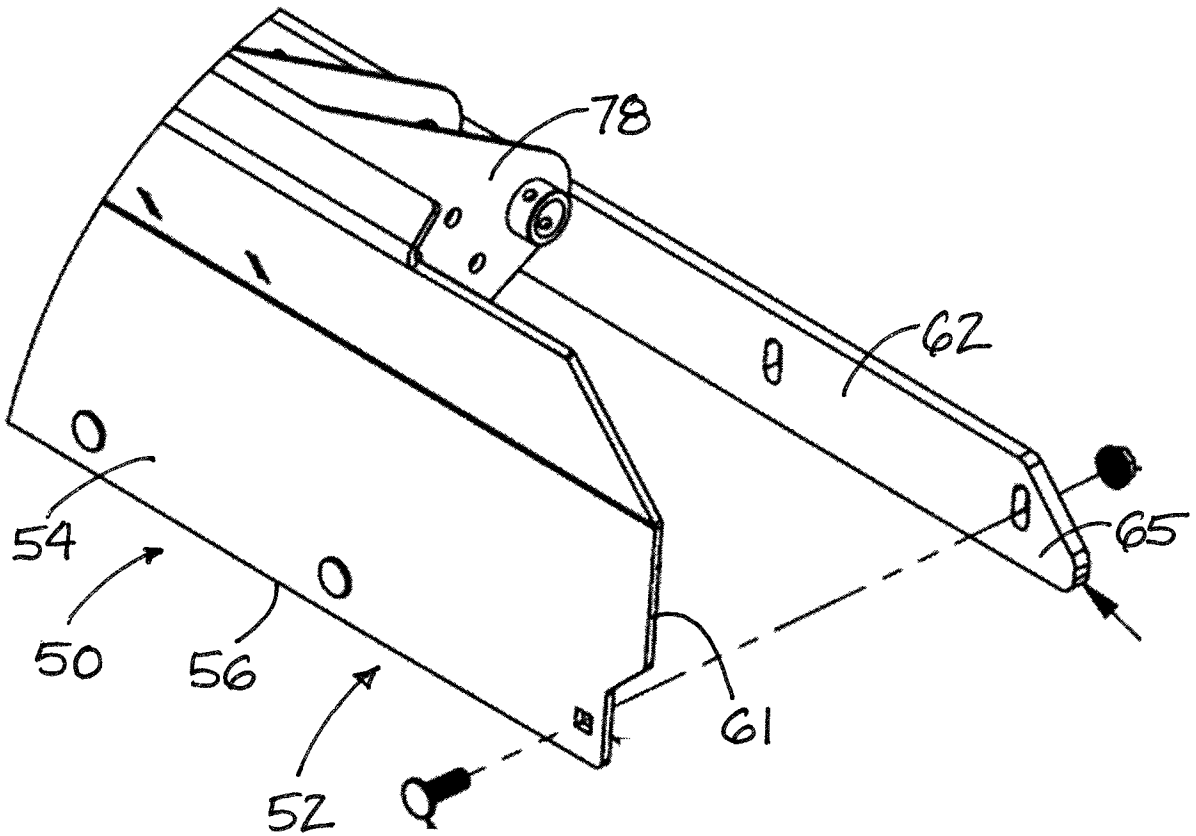
FIG. 6 is a schematic perspective view of a portion of the push blade and the wear blade in an exploded condition, according to an illustrative embodiment.
Figure 7:
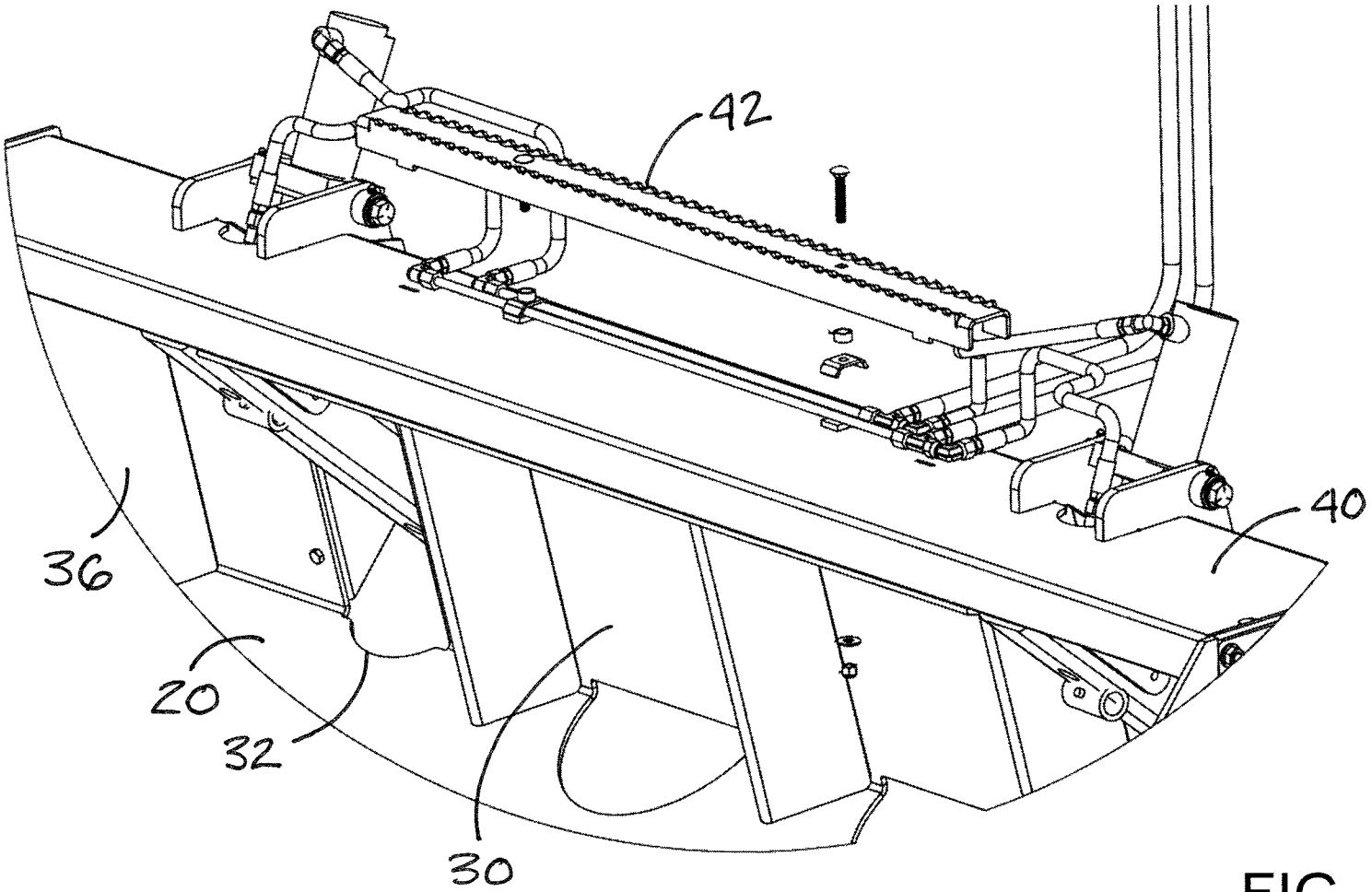
FIG. 7 is a schematic perspective view of a portion of the pusher loading bucket with the pusher removed from the bucket body, according to an illustrative embodiment.
Figure 8:
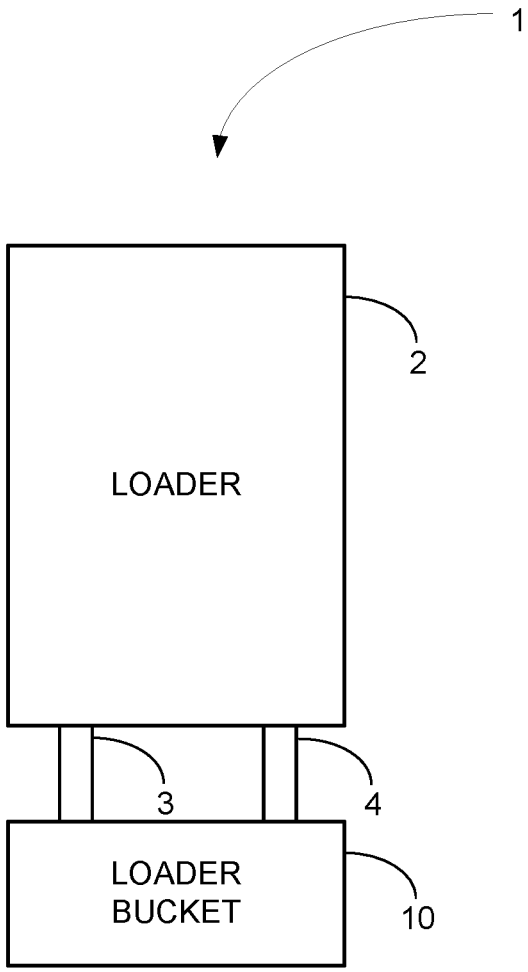
FIG. 8 is a schematic diagram of a loading system, according to an illustrative embodiment.

With reference now to the drawings, and in particular to FIGS. 1 through 8 thereof, a new pusher loading bucket embodying the principles and concepts of the disclosed subject matter will be described.

In one aspect, the disclosure generally relates to a loading system 1 for picking up and then dispensing material, generally after transporting the material for a distance. In some embodiments, the loading system 1 includes a loader 2 which includes an engine and wheels or tracks enabling the loader to move across a ground surface. The loader 2 may have at least one lift arm 3, and typically has a pair of lift arms 3, 4, which are laterally spaced with respect to each other and with respect to a central longitudinal axis of the loader. The lift arm or arms may be moved or pivoted with respect to the main frame of the loader such that the forward ends of the arms may be moved upwardly and downwardly with respect to the ground surface.

The loading system 1 may also include a loader bucket 10 which is mounted on the loader 2, and typically is mounted on the lift arm or arms 3, 4 of the loader to permit raising and lowering of the loader bucket with respect to the ground surface. The loader bucket 10 may include a bucket body 12 which may at least partially define an interior 14 for receiving material to be conveyed using the bucket 10. The bucket body 12 may have a front 16 and a rear 18, with the front typically oriented in the direction of movement of the bucket when scooping material and the rear being oriented toward the loader 2.

The bucket body 12 may include a lower wall 20 which may be positioned adjacent to the ground surface when the bucket is used for scooping material from the ground surface. The lower wall 20 may have a forward edge 22 which is positioned toward the front 16 of the bucket body and may have a cutting edge mounted on the forward edge in a manner permitting replacement or interchange of the cutting-edge as needed. The lower wall 20 may also have a rear 24 as well as opposite ends 26, 27 which extend toward the rear 24 from the forward edge 22. The lower wall 20 may also have an upper surface 28 upon which material that has been scooped into the interior 14 of the bucket body rests until dispensed or displaced from the interior. A rear wall 30 may extend upwardly from the lower wall 20 to form a rear boundary of the interior of the bucket body. In some embodiments, the rear wall may have a clearance opening 32 and a cover 34 which is mounted on the rear wall to at least partially cover the clearance opening. Suitable structure may be located on the rear wall for mounting the bucket to the lift arms of the loader.

The bucket body 12 may also include a pair of opposite side walls 36, 37 which may also extend upwardly from the lower wall to form side boundaries for the interior 14 of the bucket body 12. Each of the side walls may extend upwardly from one of the opposite ends 26, 27 of the lower wall and may be oriented substantially parallel to each other. An upper wall 40 of the bucket body may be positioned above the lower wall and may extend between the pair of side walls 36, 37. The upper wall may be oriented substantially parallel to the lower wall to form the upper boundary of the interior of the bucket body. In some embodiments, a step member 42 may be mounted on the top of the upper wall.

At least one guide 44 may be positioned adjacent to a juncture between the lower wall 20 and one of the side walls 36, 37 in order to form a guide channel 46. A pair of the guides 44, 45 may form a pair of the guide channels 46, 47 with each guide being located at one of the junctures between the lower wall and a respective side wall. Each of the guides 44, 45 may be mounted on one of the side walls, and may be oriented substantially parallel to and spaced from the lower wall to thereby form the respective guide channel. The guide channels may be positioned in substantial opposition to each other across the bucket interior.

The loader bucket 10 may also include a pusher 50 which may be primarily located in the bucket interior 14 and may be configured to assist in the moving of material in the bucket interior out of the interior without requiring tipping or tilting of the bucket in a forward direction. The pusher may be mounted on the bucket body 12 and be movable with respect to the body 12 between a retracted position (see, e.g., FIG. 3A) to an extended position (see, e.g., FIG. 3C). The retracted position of the pusher 50 may be characterized by the pusher being located toward the rear wall of the bucket body in the bucket body interior 14 to facilitate the holding of material in the interior during scooping and transporting of material using the bucket. The extended position of the pusher 50 may be characterized by the pusher being moved away from the rear wall and toward the front 16 of the bucket body such that movement of the pusher from the retracted position to the extended position tends to push or displace material which is located in the bucket body interior (and typically resting on the upper surface 22 of the lower wall) past the forward edge 22 and out of the interior 14. In some implementations, the pusher may be tilted or rotated forwardly when in the extended position as compared to the orientation in the orientation of the pusher at locations between the retracted and extended positions. The pusher may have a front 52 for contacting material located in the interior, and in some embodiments the surface of the front 52 may be curved about a substantially horizontal axis.

The pusher 50 may include a push blade 54 which is movable with respect to the bucket body, and may move with translational motion as well as pivotal motion as the pusher moves between the retracted and extended positions. The push blade may have a lower edge 56, an upper edge 58, and opposite side edges 60, 61, and may be substantially continuous between the side edges 60, 61 to facilitate ejection of many types of material, including granular or articulate material, from the interior 14 as the pusher moves from the retracted to the extended positions. Illustratively, the push blade may be formed of a sheet material of, for example, a metal, a plastic, or a composite material.

The pusher 50 may also include a wear blade 62 mounted on the push blade, and may be removable to facilitate replacement. The wear blade 62 may be mounted toward or adjacent to the lower edge 56 of the push blade 54, and may be positioned between the lower edge 56 of the blade 54 and the upper surface 28 of the lower wall of the bucket body. The wear blade 62 may have opposite end portions 64, 65 which may extend laterally from the push blade to a degree, and may extend beyond the opposite side edges 60, 61 of the push blade. The end portions of the wear blade may engage the guides 44, 45 of the bucket body. In some embodiments, each of the opposite end portions 64, 65 of the wear blade may extend into one of the guide channels 46, 47 at the respective side walls of the bucket body to thereby form a connection between the guides and the push blade and guide the movement of the lower edge and wear blade along the upper surface of the lower wall.

The loader bucket 10 may also include a pusher actuation assembly 70 which is configured to move the pusher with respect to the bucket body between the retracted position and extended position and generally move the push blade from a position adjacent the rear 24 of the lower wall toward the forward edge 22 of the wall 20. The actuation assembly 70 may include a pusher arm 72 which is mounted on the bucket body and the pusher, and may be pivotally mounted to the bucket body and the pusher. The pusher arm 72 may have a first end 74 which is pivotally mounted on the bucket body and a second end 76 which is pivotally mounted on the pusher. The second end 76 may be pivotally mounted on a mount ear 78 which is located on the rear 80 of the push blade and may extend rearwardly from the push blade. The mount ear 78 may have at least one mount point 82 for attaching the second end of pusher arm. Optionally, a plurality of mount points 82 may be located on the mount ear, and may comprise an aperture for each of the mount points configured to receive a pin that also passes through a passage formed on the second end 76 of the arm 72. In some embodiments, the mount ear 78 may extend into the clearance opening 32 of the rear wall when the pusher is in the retracted position. The cover 34 may function to protect the mount ear as well as the second end of the pusher arm when the pusher is retracted.

The actuation assembly 70 may also include a pivot 86 which is fixed to the pusher arm 72 and may be pivotally mounted on the bucket body. The pivot 86 may be attached to the first end 74 of the pusher arm and may also be pivotally or rotatably mounted on the opposite side walls 36, 37 of the bucket body. Illustratively, the pivot 86 may include a rod 88 which is mounted on the pusher arm and extends between the opposite side walls of the bucket body. The rod 88 may have opposite ends 90, 91 which are positioned adjacent to the respective side walls 36, 37 of the bucket body. The assembly 70 may also include a pivot mount 94 which is mounted on each of the opposite side walls 36, 37 of the bucket body, and each of the pivot mounts may receive one of the opposite ends 90, 91 of the rod. The rod and the pusher arm or arms mounted thereon are thereby able to pivot with respect to the bucket body. The actuator assembly 70 may further include an actuator 100 which is configured to move the pusher arm 72 with respect to the bucket body, and may pivot the pusher arm on the pivot 86. The actuator 100 may be pivotally mounted on the bucket body and on the pivot arm. In some embodiments, the actuator 100 is extendable and retractable, and extension of the actuator may cause the pusher to move toward the extended position and retraction of the actuator may cause the pusher to move toward the retracted position. Illustratively, the actuator 100 comprises a hydraulic actuator with a cylinder 102 and a ram 104, and a cylinder may be mounted on the bucket body and the ram may be mounted on the pusher arm. The mounting point of the actuator to the pusher arm may be located between the first 74 and second 76 ends, and may be located relatively closer to the first end than the second end.

In use, the bucket 10 may be used in a conventional manner with the pusher 50 maintained in the retracted position, such that a substantial portion of the interior of the bucket body is available for receiving and holding material scooped into the bucket. Material in the bucket interior may be pushed out of the interior in a rapid or a measured manner by operating the actuator 100 (e.g., using conventional hydraulic valve controls) to move the pusher from the retracted position toward the extended position. The wear blade 62 of the pusher tends to maintain the lower edge of the push blade and the position that is adjacent to the upper surface 28 of the lower wall of the bucket body as the actuation assembly 70 moves the push blade toward the front 16 of the bucket body. The channels 44, 45 of the bucket body may be configured to block movement of the wear blade beyond a particular point (generally close to the forward edge 22 of the lower wall) at which point further movement of the pusher arm may cause the push blade to rotate or tilt forwardly to facilitate more complete dumping of the material out of the bucket interior.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A loading bucket comprising:

a bucket body at least partially defining an interior and having a front and a rear, the bucket body having a lower wall with a forward edge oriented toward the front of the bucket body and an upper surface, a rear wall extending upwardly from the lower wall, a pair of opposite side walls extending upwardly from opposite ends of the lower wall, and at least one guide being positioned in the interior defined by the bucket body, the bucket body having a neutral condition in which, when the lower wall of the bucket is rested upon a ground surface, the upper surface of the lower wall of the bucket extends in a plane oriented parallel to the ground surface;

a pusher mounted on the bucket body in a manner so as to be movable with respect to the bucket body between a retracted position and an extended position with respect to the interior of the bucket body, the retracted position being characterized by the pusher being located toward the rear wall of the bucket body and the extended position being characterized by the pusher being moved away from the rear wall of the bucket body toward the front of the bucket; and a pusher actuation assembly configured to move the pusher with respect to the bucket body between the retracted position and the extended position;

wherein the pusher includes:

a lower portion which is configured to be moved by the at least one guide along the upper surface of the lower wall of the bucket body as the pusher moves toward the extended position; and an upper portion which, when the pusher is in the extended position and the bucket body is in the neutral condition, is tipped forwardly such that the upper portion is forward of the lower portion in a forward direction extending parallel to the plane oriented parallel to the ground surface and the upper portion is located out of the interior of the bucket body to facilitate ejection of contents from the interior of the bucket body and off of the pusher.

2. The loading bucket of claim 1 wherein the at least one guide includes a pair of the guides forming a pair of the guide channels with each guide being located at a respective juncture of the lower wall and one of the side walls of the bucket body.

3. The loading bucket of claim 1 wherein the upper portion of the pusher is positioned forwardly of the lower portion of the pusher in the retracted position of the pusher.

4. The loading bucket of claim 1 wherein the pusher including a push blade movable in the interior of the bucket body, the push blade having opposite side edges and being continuous between the side edges.

5. The loading bucket of claim 1 wherein the pusher includes a push blade movable in the interior of the bucket body, the push blade having a lower edge movable along the upper surface of the lower wall as the pusher moves between the retracted and extended positions.

6. The loading bucket of claim 5 wherein the pusher includes a wear blade mounted on the push blade adjacent to the lower edge of the push blade.

7. The loading bucket of claim 6 wherein the wear blade has opposite end portions, at least one of the opposite end portions engaging the at least one guide.

8. The loading bucket of claim 7 wherein the at least one end portion of the wear blade extends into the guide channel formed by the at least one guide.

9. The loading bucket of claim 2 wherein the pusher includes a push blade movable in the interior of the bucket body and a wear blade mounted on the push blade, the wear blade having opposite end portions with each of the opposite end portions engaging one of the guides.

10. The loading bucket of claim 6 wherein the wear blade is removably mounted on the push blade.

11. The loading bucket of claim 1 wherein the pusher actuation assembly comprises:

a pusher arm pivotally mounted on the bucket body and the pusher; and a pivot fixed to the pusher arm and pivotally mounted on the bucket body.

12. The loading bucket of claim 11 wherein the pivot includes:

a rod mounted on the pusher arm and extending between opposite side walls of the bucket body, the rod having opposite ends; and a pivot mount mounted on each of the opposite side walls of the bucket body.

13. The loading bucket of claim 11 wherein the pusher actuation assembly comprises an actuator configured to pivot the pusher arm with respect to the bucket body.

14. The loading bucket of claim 1 wherein the extended position of the pusher is characterized by at least a portion of the pusher being extended beyond a plane defined by the forward edge of the lower wall of the bucket body and a front edge of an upper wall of the bucket body.

15. The loading bucket of claim 1 wherein the pusher has an upper edge freely movable along an arcuate path with respect to the bucket body.

16. The loading bucket of claim 1 wherein the pusher comprises a push blade having an uppermost edge and a lowermost edge, and the push blade is rigid between the uppermost and lowermost edges.

17. The loading bucket of claim 1 wherein the pusher comprises a push blade having an uppermost edge and a lowermost edge, and the uppermost edge and the lowermost edge both move forwardly as the pusher moves from the retracted position to the extended position.

18. A loading system comprising:

a loader having at least one lift arm;

a loading bucket mounted on the at least one lift arm of the loader such that the loading bucket is pivotable with respect to the loader, the loading bucket comprising:

a bucket body at least partially defining an interior and having a front and a rear, the bucket body having an upper wall with a front edge and a lower wall with a forward edge oriented toward the front of the bucket body, the lower wall having an upper surface, the interior of the bucket body being bounded by a plane including the forward edge of the lower wall of the bucket body and the front edge of the upper wall of the bucket body, a rear wall extending upwardly from the lower wall, a pair of opposite side walls extending upwardly from opposite ends of the lower wall, and at least one guide being positioned adjacent to a juncture of the lower wall and one of side walls to form a guide channel, the bucket body having a neutral condition in which, when the lower wall of the bucket is rested upon a ground surface, the upper surface of the lower wall of the bucket extends in a plane oriented parallel to the ground surface;

a pusher mounted on the bucket body and being movable along the at least one guide over the upper surface of the lower wall of the bucket body between a retracted position and an extended position, the retracted position being characterized by the pusher being located toward the rear wall of the bucket body and the extended position being characterized by the pusher being moved away from the rear wall of the bucket body toward the front of the bucket; and a pusher actuation assembly configured to move the pusher with respect to the bucket body between the retracted position and the extended position;

wherein, when in the neutral condition, the extended position of the pusher is characterized by:

an upper portion of the pusher being located forwardly of a lower portion of the pusher in a forward direction extending parallel to the plane oriented parallel to the ground surface; and the upper portion of the pusher being located forwardly of the forward edge of the bucket body in the forward direction extending parallel to the plane oriented parallel to the ground surface;

wherein the upper portion of the pusher is located outside of the interior of the bucket body in the extended position to facilitate ejection of contents from the interior of the bucket body.

19. The system of claim 18 wherein the at least one guide includes a pair of the guides forming a pair of the guide channels with each guide being located at one of the junctures of the lower wall and one of the side walls of the bucket body.

20. The system of claim 18 wherein the pusher includes a push blade movable in the interior of the bucket body, the push blade having a lower edge movable along the upper surface of the lower wall as the pusher moves between the retracted and extended positions.

21. The system of claim 20 wherein the pusher includes a wear blade mounted on the push blade adjacent to the lower edge of the push blade.

22. The system of claim 21 wherein the wear blade has opposite end portions, at least one of the opposite end portions engaging the at least one guide.

23. The system of claim 22 wherein the at least one end portion of the wear blade extends into the guide channel formed by the at least one guide.

* * * * *